US007163162B2

(12) United States Patent
Tsuchiya et al.

(10) Patent No.: US 7,163,162 B2
(45) **Date of Patent: *Jan. 16, 2007**

(54) FUEL-INJECTION VALVE

(75) Inventors: Masahiro Tsuchiya, Tsuchiura (JP); Tosuke Hirata, Ami (JP); Yoshio Okamoto, Minori (JP); Tohru Ishikawa, Kitaibaraki (JP); Noriyuki Maekawa, Chiyoda (JP); Yoshiyuki Tanabe, Hitachinaka (JP); Atsushi Sekine, Hitachinaka (JP); Yuzo Kadomukai, Ishioka (JP); Makoto Yamakado, Tsuchiura (JP); Motoyuki Abe, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/284,407

(22) Filed: Oct. 31, 2002

(65) Prior Publication Data

US 2003/0111563 A1 Jun. 19, 2003

Related U.S. Application Data

(62) Division of application No. 09/517,046, filed on Mar. 2, 2000, now Pat. No. 6,474,572.

(51) Int. Cl.
*F02M 51/00* (2006.01)

(52) U.S. Cl. ..... 239/585.1; 239/585.5; 239/900; 239/533.9; 251/129.21

(58) Field of Classification Search .. 239/585.1–858.5, 239/533.1, 533.9, 533.11, 533.12, 584, 900; 251/129.21, 64, 48

See application file for complete search history.

(56) References Cited

U.S. PATENT DOCUMENTS

| | | | | |
|---|---|---|---|---|
| 4,515,343 | A | 5/1985 | Pischinger et al. | 251/48 |
| 4,749,892 | A | 6/1988 | Mesenich | |
| 4,798,188 | A * | 1/1989 | Ito et al. | 123/478 |
| 4,883,025 | A | 11/1989 | Richeson, Jr. | 251/48 |
| 4,917,352 | A | 4/1990 | Hauet et al. | 251/129.21 |
| 4,986,246 | A | 1/1991 | Kessler de Vivie et al. | 251/129.21 |

(Continued)

FOREIGN PATENT DOCUMENTS

| | | |
|---|---|---|
| JP | 59 205084 | 11/1984 |

(Continued)

*Primary Examiner*—Christopher Kim
(74) *Attorney, Agent, or Firm*—Antonelli, Terry, Stout and Kraus, LLP.

(57) ABSTRACT

A fuel-injection valve includes a fuel-injection hole, a valve element and a valve seat for opening and closing the fuel-injection hole, a force-applying member for applying force to the valve element in a direction of motion of the valve element, and a drive unit for applying force to the valve element in the direction opposite to that of the force applied by the force-applying member; wherein a secondary oscillation system, which interacts with a primary oscillation system including the valve element and the force-applying member, is added to the primary oscillation system, and the phase angle of force applied to the primary oscillation system by the secondary oscillation system is also staggered from that of force applied to the primary oscillation system, which is other than the force applied to the primary oscillation system by the secondary oscillation system, whereby the bouncing of the valve element during opening and closing of the valve is reduced, which in turn makes it possible to achieve very accurate fuel-injection control.

13 Claims, 13 Drawing Sheets

U.S. PATENT DOCUMENTS

| | | | | |
|---|---|---|---|---|
| 5,127,585 | A | 7/1992 | Mesenich | 239/585.5 |
| 5,348,224 | A | 9/1994 | Consadori et al. | 251/129.21 |
| 5,358,005 | A | 10/1994 | van Prooijen et al. | 251/129.21 |
| 5,458,294 | A | 10/1995 | Zachary et al. | 239/585.5 |
| 5,464,191 | A | 11/1995 | Shenk | 251/129.21 |
| 5,813,654 | A | 9/1998 | Hopley | 251/129.64 |
| 6,474,572 | B1 * | 11/2002 | Tsuchiya et al. | 239/585.1 |

FOREIGN PATENT DOCUMENTS

| | | |
|---|---|---|
| JP | 1-159460 | 6/1989 |
| JP | 6-146886 | 5/1994 |
| JP | 61 27962 | 5/1994 |

* cited by examiner

A-A' CROSS SECTION

FUEL-INJECTION VALVE

CROSS-REFERENCE TO RELATED APPLICATION

This application is a Divisional application of application Ser. No. 09/517,046, filed Mar. 2, 2000, now U.S. Pat. No. 6,474,572.

BACKGROUND OF THE INVENTION

The present invention relates to a fuel valve injection valve for injecting fuel in an internal combustion engine, and especially to a technique suitable for preventing secondary fuel injection.

Japanese Patent Application Laid-Open Hei 1-1594060 discloses an electromagnetic fuel-injection valve for opening/closing an opening in a valve seat based on an ON/OFF signal having a duty which is determined by a control unit. In this electromagnetic valve, a magnetic circuit is composed of a yoke with a bottom part, a core with a plug part to fill the aperture of the yoke and with a cylinder extending through the core center line, and a plunger facing the core, separated by a gap. A spring is inserted inside the cylinder of the core, and the spring exerts pressure on a movable element of the valve, which is composed of the plunger, a rod, and a ball member, towards the face of the valve seat. The top part of the spring, on the side opposite the plunger, contacts the bottom part of a spring-adjuster inserted in the cylinder of the core, and adjusts the load set to the spring. A coil for exciting the magnetic circuit is wound around the outside of the core and inside the yoke. In the bottom part of the yoke, there is a plunger hole for admitting the plunger, along with a valve-guide hole to admit a stopper and a valve guide, which penetrates the bottom part of the yoke, and whose diameter is larger than that of the plunger hole. The stopper is provided to set the lift value (the stroke) of the ball-valve, and the thickness of the stopper is set so that the top of the plunger does not directly contact the bottom of the core when the movable element of the valve is pulled upward. On the rod, there is a stopping face which butts against the stopper. The valve guide is a housing for containing the ball valve, a fuel-swirl-flow generating element for applying a swirling force to the fuel, and on the rod, the stopping face of the rod; and a valve-seat face and a fuel-injection hole are also located at the bottom of the valve guide.

In the above-described conventional injection valve, only the spring is inserted between the bottom of the spring adjuster and the plunger.

In an electromagnetic fuel-injection valve (hereafter referred to simply as an injection valve) including the injection valves constructed according to the conventional technique, bouncing tends to occur when the stopping face of the rod butts against the stopper during the valve-opening operation, or when the valve element is seated on the valve-seat face during the valve-closing operation. If the bouncing occurs when the valve element is seated on the valve-seat face, a secondary fuel injection occurs after the intended injection, which in turn makes it difficult to accurately control fuel injection. Also, if the bouncing occurs when the stopping face of the rod butts against the stopper, this also makes it difficult to accurately control fuel injection. A structure which is able to suppress such bouncing has not yet been achieved.

SUMMARY OF THE INVENTION

The object of the present invention is to provide a fuel-injection valve which is capable of suppressing secondary fuel injection, thereby more accurately controlling the injection of fuel.

To attain the above object, the present invention provides a secondary oscillation system including a valve element and a force-applying member for applying a force to the valve element, which force is applied to a primary oscillation system. Further, the secondary oscillation system is composed such that the phase angle of oscillation generated by the secondary oscillation system is different from that in the primary oscillation system, so as to suppress any bouncing promoted by the primary oscillation system.

To suppress bouncing, there is a linked movable member which moves almost simultaneously in the same direction as the valve element located between the valve element for opening/closing the fuel-injection hole and a spring that presses the valve element against a valve seat, and there is also an elastic member whose form can be deformed in the direction of motion of the valve element located between the movable member and the valve element.

Also, there is a linked movable member which can move almost simultaneously in the same direction as the valve element located between the valve element for opening/closing the fuel-injection hole and a spring that presses the valve element against a valve seat, so that a damping force is exerted against the movement of the linked movable member.

Here, the "linked movable member" refers to a movable member that moves along with the opening/closing operation of the valve element, but the movement of the movable member need not completely coincide with that of the valve element.

DETAILED DESCRIPTION OF THE EMBODIMENTS

Hereafter, details of various embodiments will be explained with reference to the drawings.

Figure 1:
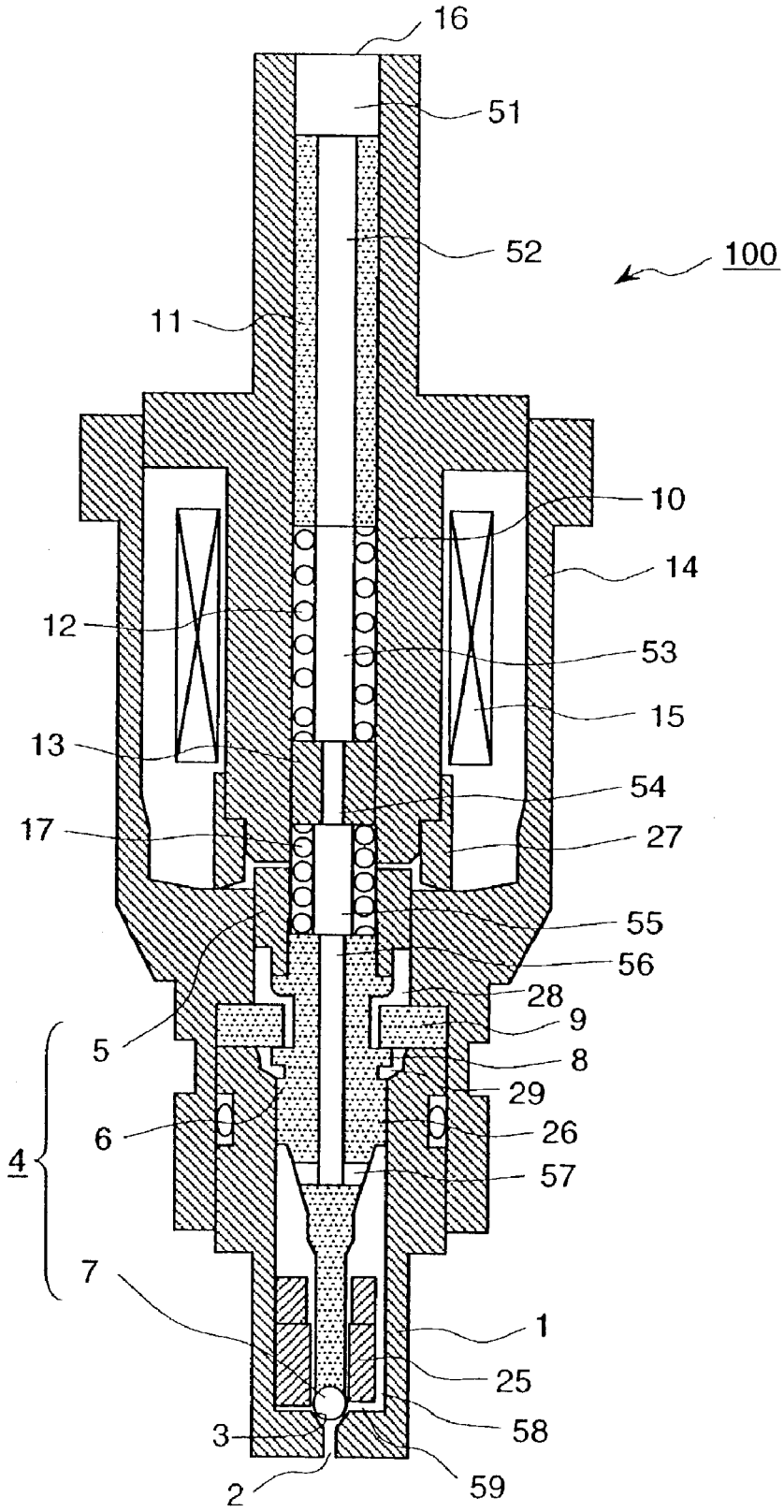
FIG. 1 is a vertical cross section of an electromagnetic fuel-injection valve representing an embodiment according to the present, invention.

FIG. 1 shows an electromagnetic fuel-injection valve representing an embodiment according to the present invention. In this embodiment, the side on which there is a fuel-injection hole 2, and the side on which the valve element 4 and the fuel-feeding inlet 16 are located, which is opposite to the fuel-injection hole 2, are defined as the lower and upper sides, respectively, of the electromagnetic fuel-injection valve. Further, the valve axis direction or the direction along the valve axis refers to the direction in which the valve element is driven (the up/down direction).

In the electromagnetic fuel-injection valve 100 (hereafter referred to simply as the fuel-injection valve), there are an outer cylindrical iron core 14 with a bottom part, which also serves as the casing of the fuel-injection valve 100; an inner cylindrical iron core 10 provided inside the outer iron core 14 (referred to as the yoke 14), in which there is a hole penetrating and extending through the center of the inner iron core 10 (referred to simply as the core 10); and a coil 15 inside the outer iron core 14 and outside the inner iron core 10. On the bottom part of the outer iron core 14, there is a small-diameter hole 28 as well as a large-diameter hole 29 under the hole 28. Furthermore the valve element 4 composed of a movable iron core 5, a rod 6, and a ball 7, is inserted into and passes through the holes 28 and 29. Moreover, a nozzle body 1 is inserted in the larger-diameter hole 29 from the bottom side of the outer iron core 14 and fixed therein, and this abuts against a stopper 9, which prescribes the stroke of the valve element 4.

The nozzle body 1 is a casing containing the ball 7, a fuel-swirling-flow generating device 25 in which a fuel passage for exerting a swirling force on the fuel is provided, and the rod 6. Also, in the bottom of the nozzle body 1, there is a fuel-injection hole 2, as well as a valve seat 3 (a seat face) upstream of the fuel-injection hole 2. The ball 7, which closes the fuel-injection hole 2, is connected to the bottom of the rod 6, and the top of the rod 6 is connected to the movable iron core (the plunger) 5. The ball 7 is guided in the same direction as the valve axis by an inner wall surface, which has a diameter slightly larger than that of the ball 7, and which is formed inside the fuel-swirling-flow generating device 25. Moreover, there is a precision-processed slide surface 26 on the rod 6, which slide surface 26 of the rod 6 is guided in the direction of the valve axis by the inner surface of the nozzle body 1.

On the rod 6, there is a shoulder 8 facing the stopper 9 disposed above the slide surface 26. The valve element 4 can slide from the bottom position at which the ball 7 contacts the valve seat 3 to the top position at which the shoulder part 8 contacts the stopper 9. The thickness of the stopper 9 is set such that a gap is formed between the movable iron core 5 and the inner iron core 10 when the valve element 4 is located at the top position. Fuel is fed from the fuel-feed inlet 16, and introduced to the fuel-injection hole 2 through the fuel passages 51–59.

Further, a seal ring 27 mechanically fixed to the inner iron core 10 and outer iron core 14 is attached to the outer surfaces of the bottom part of the inner iron core 10 and the top part of the movable iron core 5. This seal ring 27 prevents the fuel from leaking from the contact face between the inner iron core 10 and the movable iron core 5 into the space containing the coil 15.

In the hole which passes through the center part of the inner iron core 10 along the axis, a spring adjuster 11, the first spring 12, a linked movable member 13, and the second spring 17 are disposed in succession. The spring adjuster 11 is fixed to the inside surface of the inner iron core 10. The top and bottom of the spring 12 contact the bottom of the spring adjuster 11 and the top of the linked movable member 13, respectively, and the spring 12 is set in a compressed state. Also, the top and bottom of the second spring 17 contact the bottom of the linked movable member 13 and the top of the valve element 4, respectively, and the spring 17 is set in a compressed state. The linked movable member 13 can slide along the axis in the hole which passes through the center part of the inner iron core 10.

The spring force due to the spring 12 is transmitted to the valve element 4 via the linked movable member 13; and the ball 7 of the valve element 4 is pressed against the valve seat 3. In this state of the valve element 4, since the fuel passage is closed, fuel is not injected from the fuel-injection hole 2.

When current flows in the coil 15, a magnetic circuit is formed by the inner iron core 10, the movable iron core 5, and the outer iron core 14. Thus, the movable iron core 5 is pulled toward the inner iron core 10 by electromagnetic force, and the valve element 4 moves to the top position. In this state of the valve element 4, since a gap is formed between the ball 7 of the valve element 4 and the valve seat, the fuel passage is opened, and the fuel is then injected from the fuel-injection hole 2. Here, the inner iron core 10, the movable iron core 5, and the outer iron core 14 are made of magnetic material.

The fuel-injection valve functions to control the amount of fuel-feeding by changing the position of the valve element 4.

When changing the position of the valve element 4, a collision between the valve element 4 and the valve seat 3, or between the valve element 4 and the stopper 9, occurs. A slight variation in the amount of fuel injected may occur due to the bouncing of the valve element 4 as a result of the collision. Therefore, a suppression of that bouncing is desired.

Figure 2:
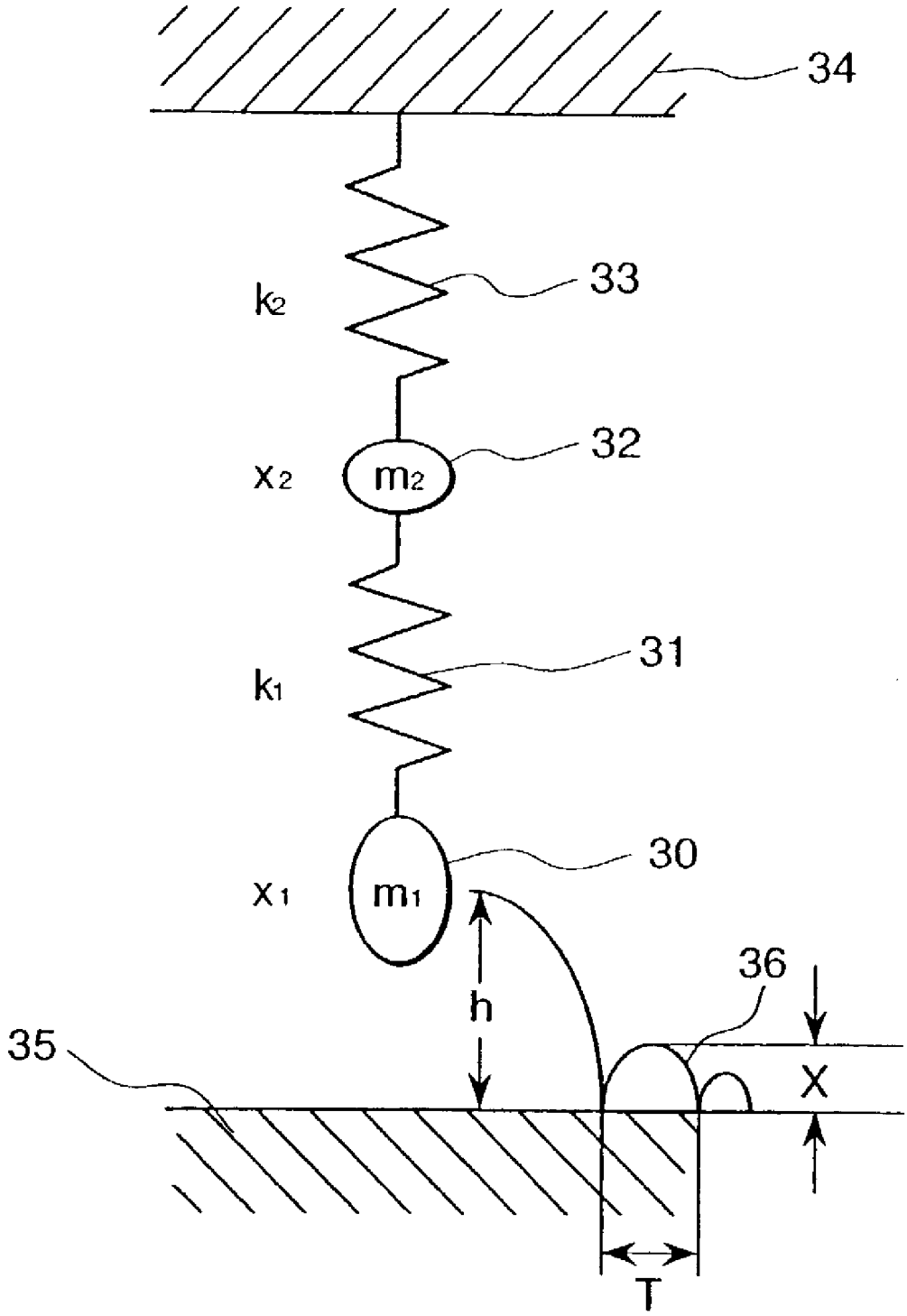
FIG. 2 is a diagram showing a dynamic model of a system with two degrees of freedom.

The dynamics of the plunger system shown in FIG. 1 can be simulated by replacing the plunger system with the dynamic model of a system with the two degrees of freedom shown in FIG. 2. In this model, the spring adjuster 11, the first spring 12, the linked movable member 13, the second spring 17, the valve element 4, and the valve seat 3 are represented by the ceiling 34, the spring 33, the mass 32, the spring 31, the mass 30, and the floor 35, respectively. The dynamics of the opening operation of the valve element 4 were simulated using this model.

Expressing the mass quantity of the mass 32, the displacement of the mass 32, the mass quantity of the mass 30, and the displacement of the mass 30, the spring constant of the spring 33, and the spring constant of the spring 31 by $m_2$, $x_2$, $m_1$, $x_1$, $k_2$, and $k_1$, respectively, the equations of motion are described by the following equations (1) and (2).

$$m_2\frac{d^2x_2}{dt^2}+k_2x_2+k_1(x_2-x_1)=0 \tag{1}$$

$$m_1\frac{d^2x_1}{dt^2}+k_1x_1-k_1x_2=0 \tag{2}$$

The initial condition is given as that in which an upward force is applied to the mass 30, and the springs 31 and 33 are left in a compressed state. Further, it is assumed that the mass 30 is lifted by a height expressed by h from the floor 35. That is, the movable stroke of the valve element 4 is h.

Figure 3A:
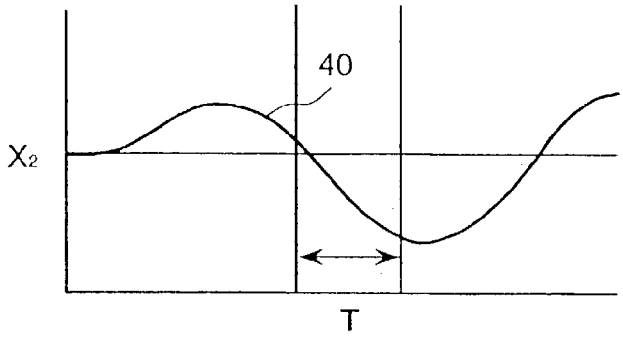
FIG. 3(A) is a diagram depicting a graph showing the movement trajectory of the linked movable member.
Figure 3B:
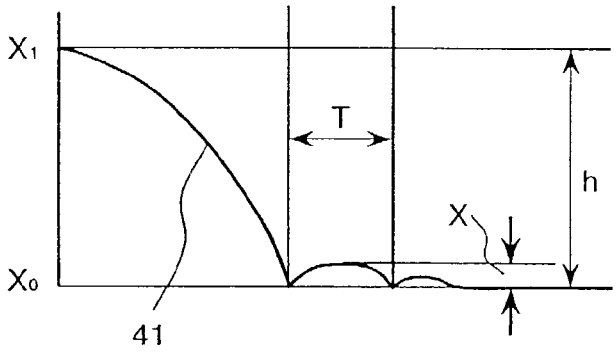
FIG. 3(B) is a diagram depicting a graph showing the movement trajectory of the valve element, which are simulated with the dynamic model shown in FIG. 2.

Furthermore, it is assumed that the coefficient of rebound between the mass 30 and the floor 35 is 0.5. With the above conditions, the equations (1) and (2) of motion are solved, and the motion trajectory 36 of the mass 30 is thereby obtained. The height of the first rebound and the time during the rebound are expressed by x and T, respectively. Since the amount of fuel injected is proportional to the integrated value of the motion trajectory 36 with respect to time, the amount of fuel secondarily injected by the rebound can be approximated by the product of x and T. By giving the values of the spring constants $k_1$ and $k_2$, and the mass quantities $m_1$ and $m_2$ of the masses 30 and 32, the motion trajectories of the masses 30 and 32 can be calculated, and an example of the results is shown in FIGS. 3(A) and 3(B). The graph of FIG. 3(A) shows the motion trajectory 40 of the mass 32, and the graph of FIG. 3(B) shows the motion trajectory 41 of the mass 30.

In FIGS. 3(A) and 3(B), T indicates the time interval during the rebound. Thus, the mass 30 jumps upward from the floor 35—that is, the valve seat 3—for the time interval T. During the rebound, the upper mass 32 acts on the lower mass 30 so as to press the mass 30 downward. This action of the mass 32 suppresses the rebound of the mass 30, which in turn decreases the amount of the fuel secondarily injected by the rebound.

In the following steps 91–96, which obtain both the values of the spring constants $k_1$ and $k_2$, and those of the mass quantities $m_1$ and $m_2$ of the mass 30 and the mass 32, which minimize the amount of the fuel secondarily injected by the rebound, will be explained.

Step 91:

The amount of the fuel secondarily injected by the rebound is approximated by the product of x and T shown in FIG. 2, and the value of xT is used as an objective function. Further, design variables of the spring constants and the mass quantities in the equations of motion for the movable members are parametrically changed.

Step 92:

A calculation range (lower limit≦design≦variable upper limit) for each design variable, a calculational step, and levels are determined, and are written in Table 1. In Table 1, the mass quantities $m_1$ and $m_2$, and the spring constant $k_1$ are designated as the design variables. If interactions exist among the design variables (design variables cannot be considered as mathematically independent), reference numbers of interacting design variables are written in Table 1 in a corresponding column for designating interactions.

TABLE 1

| No. | Design Variable | Upper Limit | Lower Limit | Interaction | Levels |
|---|---|---|---|---|---|
| 1 | $m_1$ | | | 2, 3 | |
| 2 | $m_2$ | | | 3, 1 | |
| 3 | $k_1$ | | | 1, 2 | |

Next, parametrically changing each design variable within its calculation range, the equations of motion (1) and of motion (2) are solved, and the objective function is calculated for each combination of values for the design variables. The resultant relational list between values of the objective function and combinations of values for the design variables is written in Table 2. Table 2 can be also made according to an orthogonal array table used in the design of an experiment.

TABLE 2

| | Design Variables | | | Objective Function |
|---|---|---|---|---|
| No. | $m_1$ | $m_2$ | $k_1$ | xT |
| 1 | | | | |
| 2 | | | | |
| n | | | | |

An equation expressing a curved surface for estimating the amount of the fuel secondarily injected by the rebound is obtained using Chebyshev orthogonal polynomials based on the data in Table 2.

Step 94:

Table 3 for the analysis of variance is created based on the relational list between values of the objective function and combinations of values for the design variables in Table 2. Further, the reliability and the confidence limit of the obtained equation expressing a curved surface for estimating the amount of the fuel secondarily injected due to rebound are calculated based on Table 3. The values of the reliability and the confidence limit correspond respectively to those of the mass quantities $m_1$ and $m_2$, and the spring constants $k_1$ and $k_2$ minimizing the amount of the secondarily injected fuel, which is obtained by the process of steps 91–96.

Figure 4:
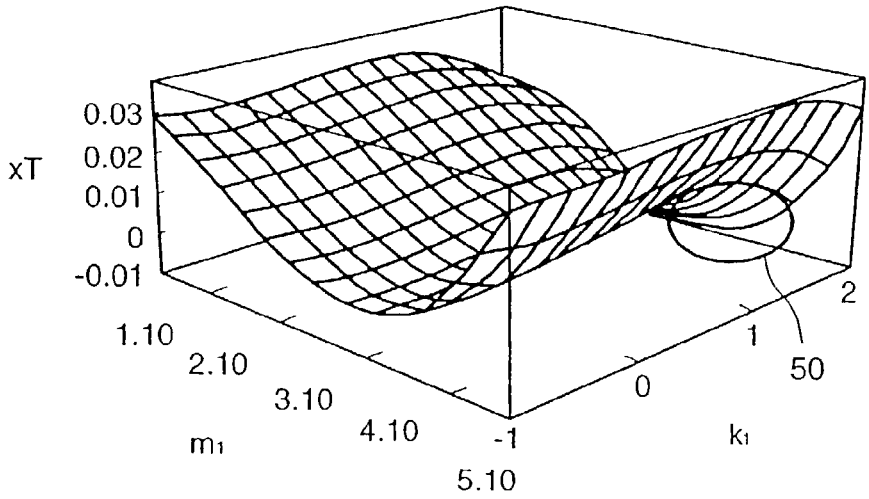
FIG. 4 is a three-dimensional graph showing changes in the amount xT of the secondary fuel injection obtained by simulations in which the mass quantity $m_2$ of the mass 32 and the spring constant $k_1$ of the spring 31 is given and fixed, and the mass quantity ml of the mass 30 and the spring constant $k_2$ of the spring 33 are parametrically changed.

Step 95:

The obtained equation expressing a curved surface for estimating the amount of the fuel secondarily injected due to rebound is graphically expressed along with the region of the design variables minimizing the fuel secondarily injected due to rebound; that is, the conditions of the mass quantities $m_1$ and $m_2$, and the spring constants $k_1$ and $k_2$ minimizing the amount of the fuel secondarily injected due to rebound are obtained. An example of the graphic expression is shown in FIG. 4, which shows a three-dimensional graph expressing the amount of the fuel secondarily injected due to rebound with respect to the mass quantity $m_1$ of the mass 30 and the spring constant $k_2$ of the spring 33, when the mass quantity $m_2$ of the mass 32 and the spring constant $k_1$ of the spring 31 are given. The region 50 of the design variables minimizing the fuel secondarily injected due to rebound is read off the three-dimensional graph shown in FIG. 4. If the region 50 does not satisfy the design conditions, another optimal-region candidate is searched out.

TABLE 3

| Term | Order of Term | Variation | Variance | Variance-ratio | Significance | Contribution Ratio |
|---|---|---|---|---|---|---|
| $m_1$ | 1st | | | | | |
| | 2nd | | | | | |
| | 3rd | | | | | |
| $m_2$ | 1st | | | | | |
| | 2nd | | | | | |
| | 3rd | | | | | |
| $k_1$ | 1st | | | | | |
| | 2nd | | | | | |
| | 3rd | | | | | |
| $m_1*m_2$ | 1st*1st | | | | | |
| | 1st*2nd | | | | | |
| | 1st*3rd | | | | | |
| | 2nd*1st | | | | | |
| | 2nd*2nd | | | | | |
| | 2nd*3rd | | | | | |
| | 3rd*1st | | | | | |
| Error Sum | | | | | | |

Step 96:

The objective function is calculated with a finer calculation mesh than that used in the above steps for the obtained region of the design variables, which was obtained in step 95.

As mentioned above, by using the plunger composition with two degrees of freedom, it is possible to suppress the secondary fuel-injection due to rebound, which in turn achieves a stable lean burn.

Figure 5A:
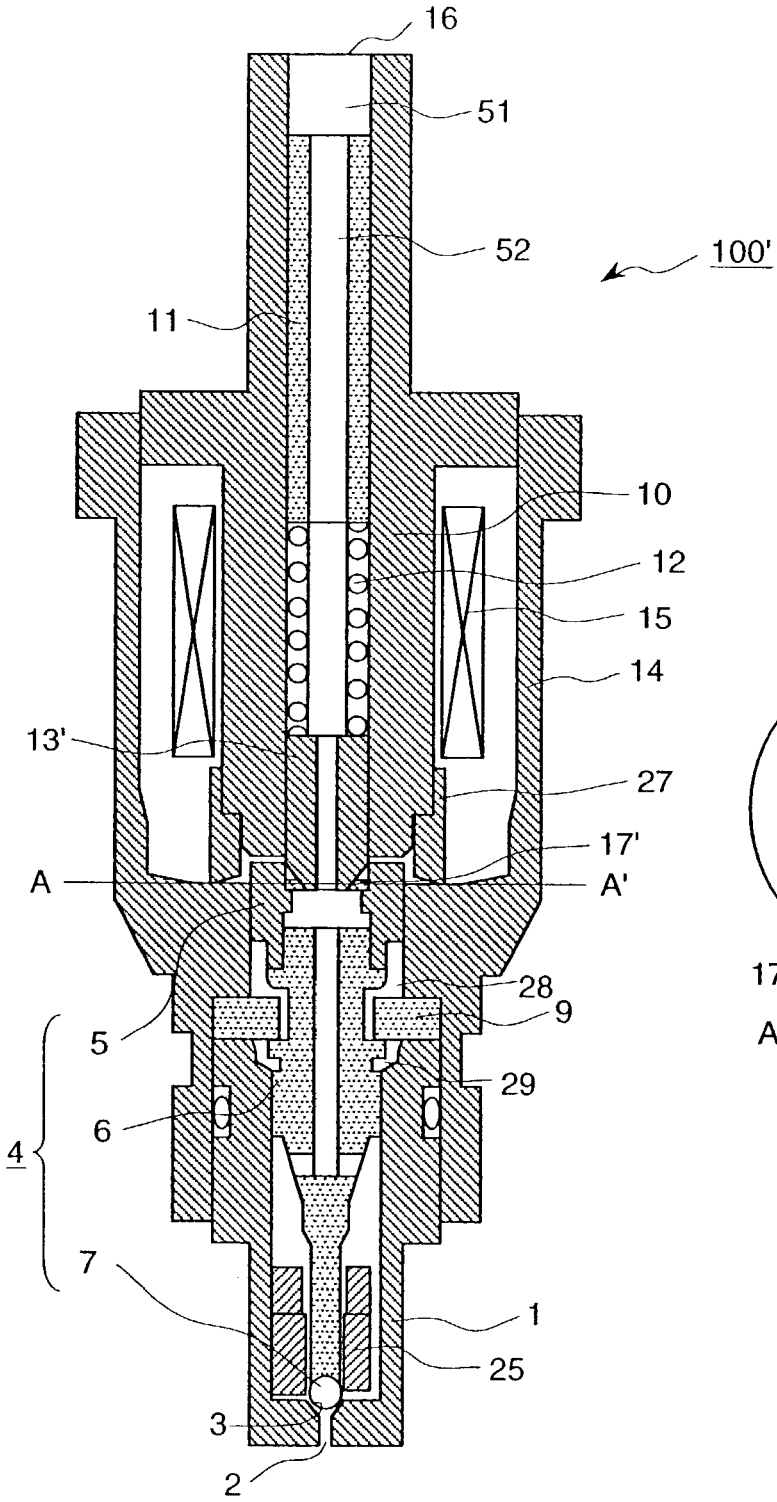
FIG. 5A is a vertical cross section of an electromagnetic fuel-injection valve representing another embodiment according to the present invention, in which the spring 17' is provided in the form of a plate spring.
Figure 5B:
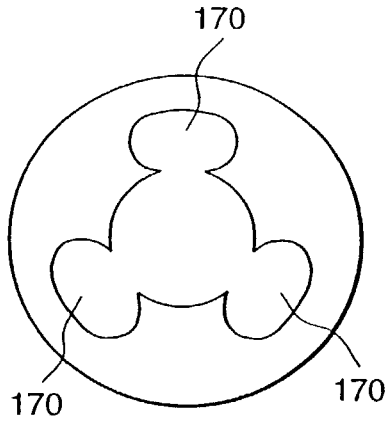
FIG. 5B is a horizontal cross section, of the plate spring 17' viewed from the line A–A'.

The plate spring 17' can be used in place of the spring 17 as shown in FIG. 5A, and this makes it possible to provide a shorter fuel-injection valve 100'. The plate spring 17' includes a stopping face against which the bottom of the linked movable member 13' butts, and, with the stopping face oriented upward, is set inside the hole, which possesses an aperture at the top of the movable iron core 5. In this embodiment, the plate spring 17' is shaped as a ring plate member which possesses notches 170 on its inner periphery, as shown in FIG. 5B, which represents a cross section of the plate spring 17', as seen along line A–A' in FIG. 5A. The outer peripheral side face of the plate spring 17' is fixed to the inner surface of the hole in the top part of the movable iron core 5. There are parts projecting from the inner periphery of the plate spring, and they form the stopping face against which the bottom of the linked movable member 13' butts.

Examples of the processes in which the bouncing of the valve element 4 is suppressed by the linked movable member 13' and the spring 17' during the valve-opening/closing operation will be explained with reference to FIG. 6 and FIG. 7.

Figure 6:
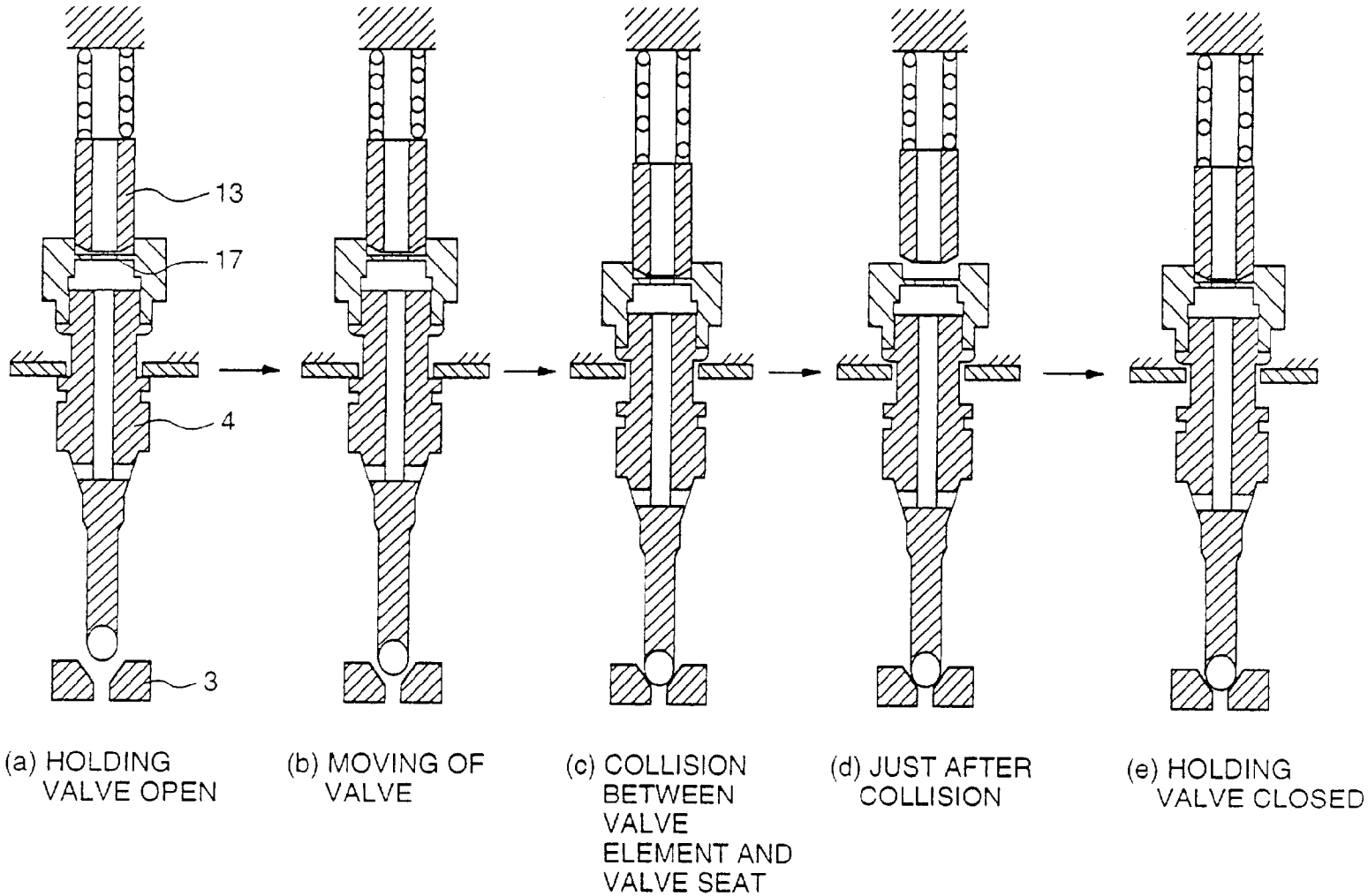
FIG. 6 is a diagram showing the succession of states in the process of suppressing the bouncing in the state transition depicted from the state (a) showing the open-valve condition to the state (e) showing the closed-valve condition, which is achieved by the fuel-injection valve shown in FIG. 5.

FIG. 6 shows the process of suppressing the bouncing by depicting the motions of the valve seat 3, the valve element 4, the spring 12, and the linked movable member 13' in the transition state shown from the diagram (a) showing the open-valve state, to the diagram (e) showing the closed-valve state.

(a) When holding the valve open, the valve element 4 is held at the top position by electromagnetic force.

(b) In the valve moving state, the electromagnetic force is interrupted, and the valve element 4 and the linked movable member 13' are moved towards the valve seat 3 by the spring force.

(c) The valve element 4 butts against, the valve seat 3.

Figure 7A:
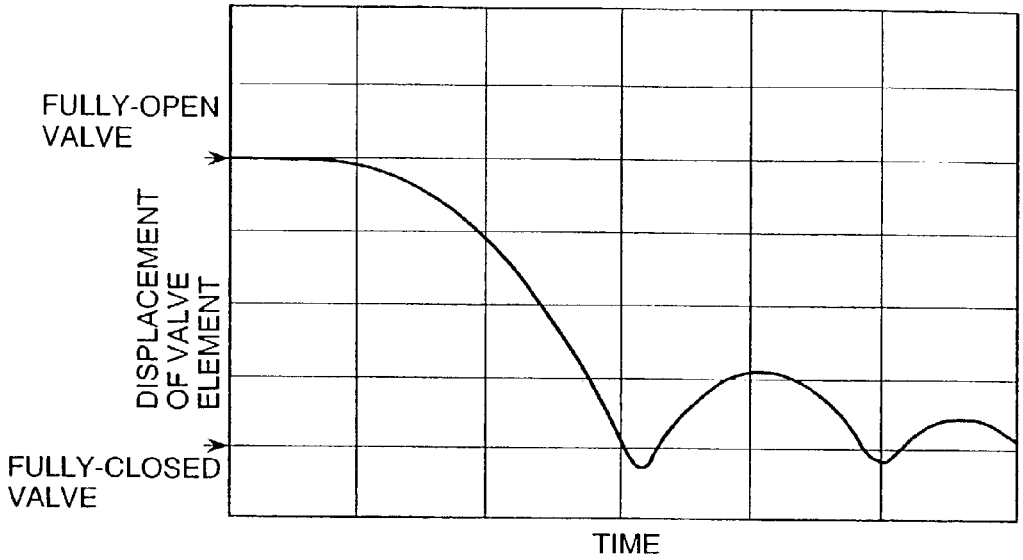
FIG. 7A is a graph showing changes in the displacement of the valve element without the plate spring 17 in the fuel-injection valve shown in FIG. 5.
Figure 7B:
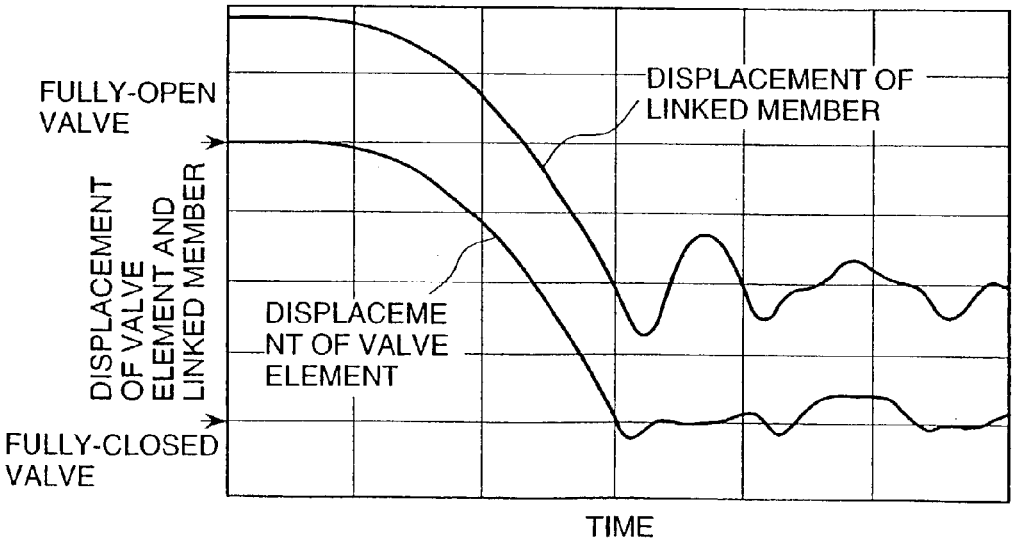
FIG. 7B is a graph showing changes in the displacement of the valve element with the plate spring 17 in the fuel-injection valve shown in FIG. 5.

(d) Just after the collision, the linked movable member 13' rebounds upward due to the shock of the collision. FIGS. 7A and 7B show two different cases of displacement changes of the valve element 4 and the linked movable member 13', respectively. FIG. 7A and FIG. 7B are graphs showing changes in the displacement of the valve element with and without the plate spring 17' in the fuel-injection valve shown in FIG. 5, respectively. The secondary oscillation system composed of the linked movable member 13' and the spring 17' is adjusted such that the characteristic frequency of this secondary oscillation system is equal or almost equal to the frequency of the shock force due to the collision. For example, it is appropriate to set the mass quantity of the linked movable member 13' and the spring constant of the plate spring 17' to 0.3–1.5 g and 100–1000 kgf/mm, respectively. By these settings, the secondary oscillation system functions as a shock absorber. That is, only the linked movable member 13' rebounds significantly upward due to the shock force of the collision, which in turn suppresses the bouncing of the valve element 4.

(e) When holding the valve closed, the linked movable member 13' is again held in contact with the valve element 4.

The fuel-injection hole 2 is opened by the bouncing, which in turn causes secondary and tertiary fuel injections. Those two unintentional fuel injections also cause a slight variation in the amount of fuel injected. Therefore, by suppressing the bouncing, an accurate control of the amount of fuel injected becomes possible.

The spring 17' functions as a plate spring whose inner peripheral part is displaced in the valve axis direction, that is, it is bent. A load of about 2–10 kgf, due to the force caused by the spring 12, the force of inertia of the linked movable member 13' and so on, is applied to the inner peripheral area of the spring 17'. If there are no notches 170 on the inner peripheral part, the stress in the inner peripheral area due to the above load becomes very large, and this makes it difficult to maintain the durability of the spring 17'. On the other hand, if the thickness of the spring 17' is increased so as to decrease the stress, the spring constant of the spring 17' becomes to large, and the bounce-suppressing effect is lost. By providing the notches 110, the stress generated in the inner peripheral area of the spring 17' is reduced. Thus, it has become possible to create a spring with an appropriate spring constant and a high durability, in which there is no high degree of stress.

There are three notches in the plate spring 17'. By making the linked movable member 13' contact three parts of the spring 17', stable contact between the linked movable member 13' and the spring 17' can be always attained even if the spring is not completely flat, and the spring constant designated as the design value can be accurately attained. Therefore, it is not necessary to precisely control the flatness when fabricating the spring 17', and this decreases its fabrication cost. Thus, the stable bounce-suppressing effect of the fuel injection valve according to this embodiment can be obtained. Further, since the support of the linked movable member 13' is stable, the member rarely inclines, which in turn prevents the abrasion of the slide portion in the inner surface of the inner iron core 10.

A press working is suitable for fabricating the spring 17' at a low cost. Although it is difficult to precisely control the flatness of the spring 17' with a press working, since the precise control of the flatness is not necessary since the linked movable member 13' is made to contact three positions of the spring 17', a press working can be used to fabricate, the spring 17'.

In this embodiment, there is a guide surface for the linked movable member 13' on the bottom portion inside the spring 17'. Further, there is a small-diameter portion on the bottom of the linked movable member 13', and this small-diameter portion is inserted into the inside hole of the spring 17'. Accordingly, a centering error between the spring 17' and the linked movable member 13' hardly occurs, and this makes the spring constant of the spring 17' stable.

Moreover, it is possible to guide the outer surface of the linked movable member 13' along the guide faces formed on the inner surface of the movable iron core 5. In this structure, it is desirable to select adequate material for the movable iron core 5, or to improve the inner surface of the movable iron core 5, in order to increase its abrasion resistance.

Furthermore, it is possible to fabricate the linked movable member 13' and the movable iron core 5 so as to provide a united structure, if this does not cause a problem from the viewpoint of shock-resistance between the linked movable member 13' and the spring 17', or a problem when determining the spring constant during the design of the spring 17'. This structure decreases the number of parts used in making the fuel-injection valve.

Although bouncing can be suppressed by making use of the viscosity resistance force of the fuel, since it is necessary to provide a narrow bypass passage for the fuel, precise size-control of the parts or portions, which form the narrow bypass passage is required. Further, since the change in the fuel viscosity due to an increase in the fuel temperature, etc. makes the bounce-suppressing effect unreliable a countermeasure to this problem is necessary.

Further, it is desirable to chamfer the bottom of the linked movable member 13' as shown in FIG. 5 so as to decrease the contact area between the linked movable member 13' and the spring 17'. Since this keeps the contact area receiving the load from the upper parts constant, a stable spring force can be obtained.

Furthermore, it is desirable to reduce the slide-abrasion by applying surface-processing, such as quenching, nitrification, plating, and so on, to at least one among the outer surface of the linked movable member 13', the inner surface' of the inner iron core 10, and the inner surface of the movable iron core 5.

Also, it is desirable to reduce the slide-abrasion by applying surface-processing, such as quenching, nitrification, plating, and so on, to one or both of the butting faces. of the linked movable member 13' and the spring 17'.

An example of the bounce-suppressing process is shown in FIG. 6 and FIG. 7, and other processes may be possible depending on the spring load, and the shapes of the fuel passage, the magnetic circuit, the stopper, etc. For example, it be possible that if the electromagnetic force is interrupted during the open-valve state, the valve element 4 may become separated from the linked movable member 13', and collide with the valve seat 3, while a very slight gap remains between the valve element 4 and the linked movable member 13'. In this situation, when the valve element 4 rebounds from the valve seat 3, since the linked movable member 13' collides with the valve element 4 after a short time lag, the bouncing is suppressed.

Although it is desirable to set the characteristic frequency of the secondary oscillation system composed of the linked movable member 13' and the spring 17' to a frequency near the frequency of the collision force, even when it is not set at a frequency near the frequency of the collision force, the characteristic frequency of the oscillation system can still be set to a frequency such that the bouncing of the valve element 4 can be suppressed.

Further, the friction force between the linked movable member 13' and the inner iron core 10 can be used as a damping force for bounce suppression. In this composition, the spring 17' is not always necessary.

If a decrease in the viscosity of the fuel does not cause a severe problem, the viscosity resistance force of the fuel between the outer surface of the linked movable member 13' and the inner-wall surface of the inner iron core 10 can be used for bounce suppression. Since it is possible to make the linked movable member 13' longer by making use of the fuel passage space inside the inner iron core 10, a large and stable fuel based viscosity resistance force can be obtained. In this composition also, the spring 17' is not always necessary.

In the following, another example of the bounce-suppression process for the valve element 4 will be explained with reference to FIG. 8 and FIG. 9.

Figure 8:
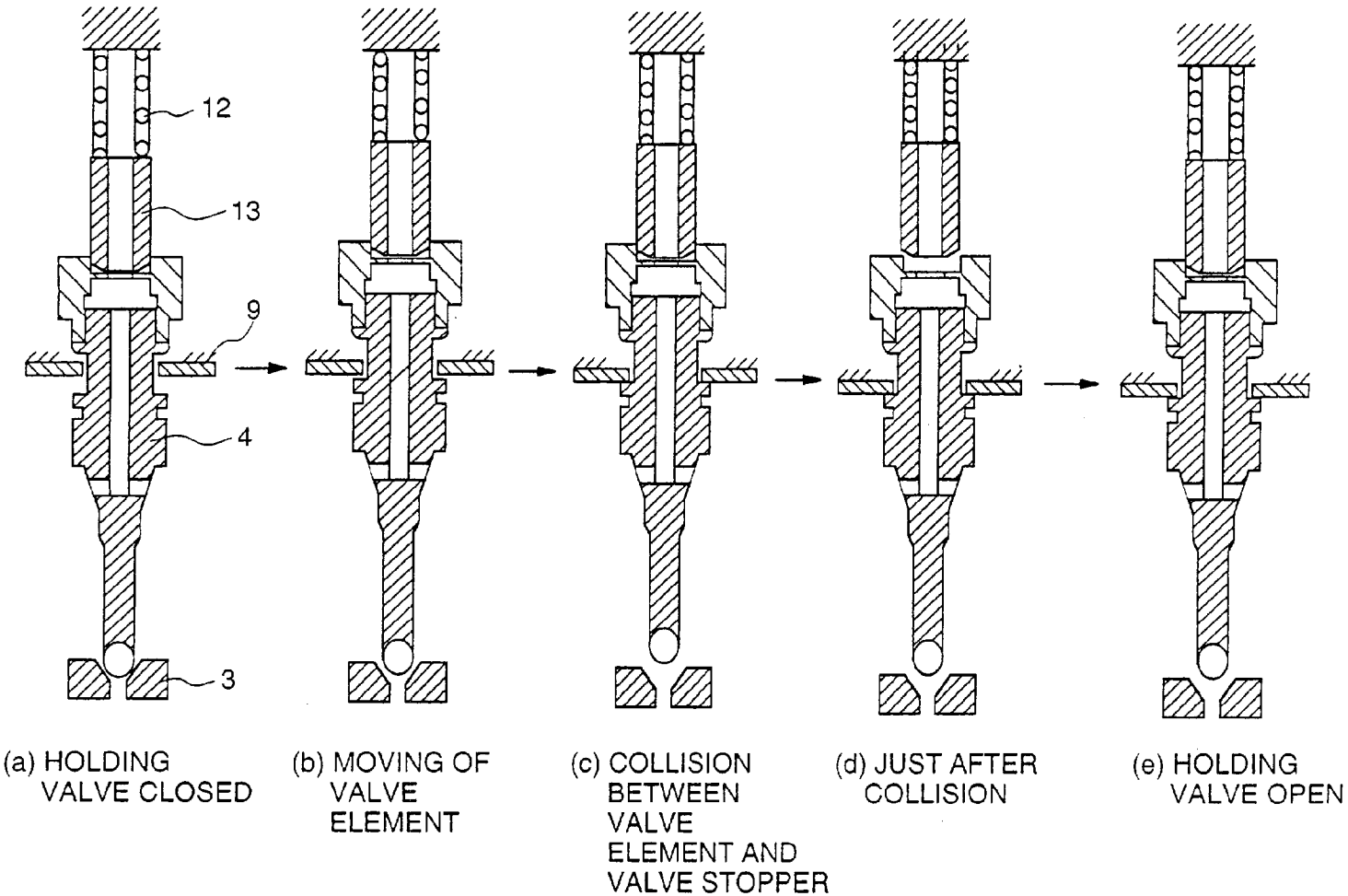
FIG. 8 is a diagram showing the succession of states in the process of suppressing the bouncing in the state transition depicted from the state (a) showing the close-valve condition to the state (e) showing the open-valve condition, which is achieved by the fuel-injection valve shown in FIG. 5.

FIG. 8 shows the bounce-suppression process by depicting the motions of the valve seat 3, the valve element 4, the spring 12, and the linked movable member 13' in the transition state shown from the diagram (a) showing the closed-valve state, to the diagram (e) showing the open-valve state.

(a) When holding the valve closed, the valve element 4 is pressed against the valve seat 3 by the spring force.

(b) In the valve moving state, the valve element 4 and the linked movable member 13' are moved upwards by the electromagnetic force.

(c) The valve element 4 butts against the stopper 9.

(d) Just after the collision, the linked movable member 13' jumps upward due to the force of inertia. Since the valve element 4 is temporarily separated from the linked movable member 13', and the spring force reflecting the valve element 4 disappears, the bouncing is suppressed.

(e) When holding the valve open, the linked movable member 13' again contacts the valve element 4.

Figure 9A:
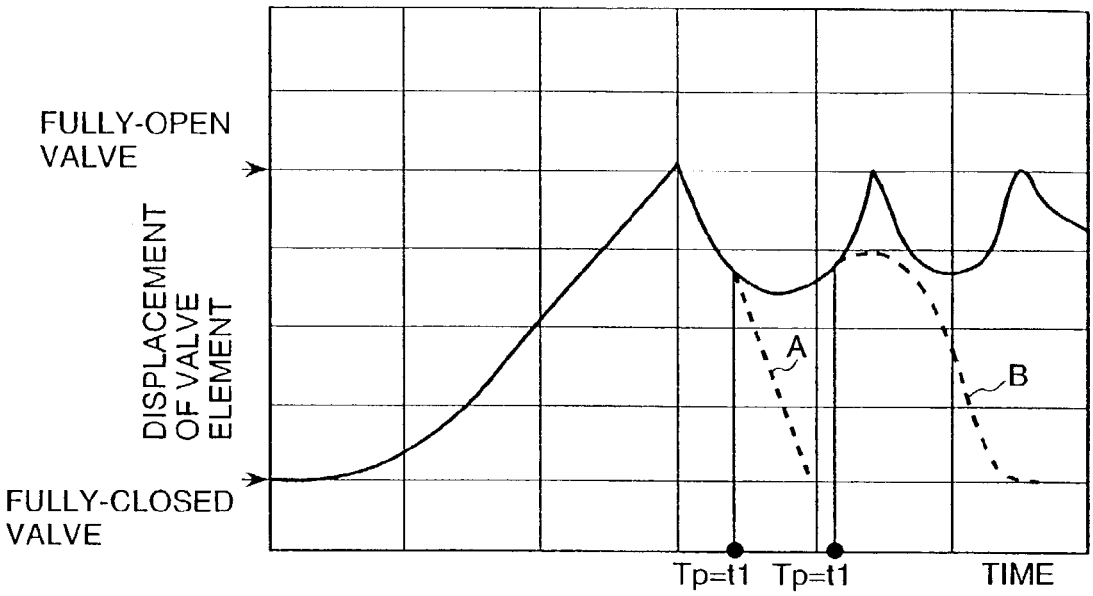
FIG. 9A is a graph showing changes in the displacement of the valve element without the plate spring 17 in the fuel-injection valve shown in FIG. 5.
Figure 9B:
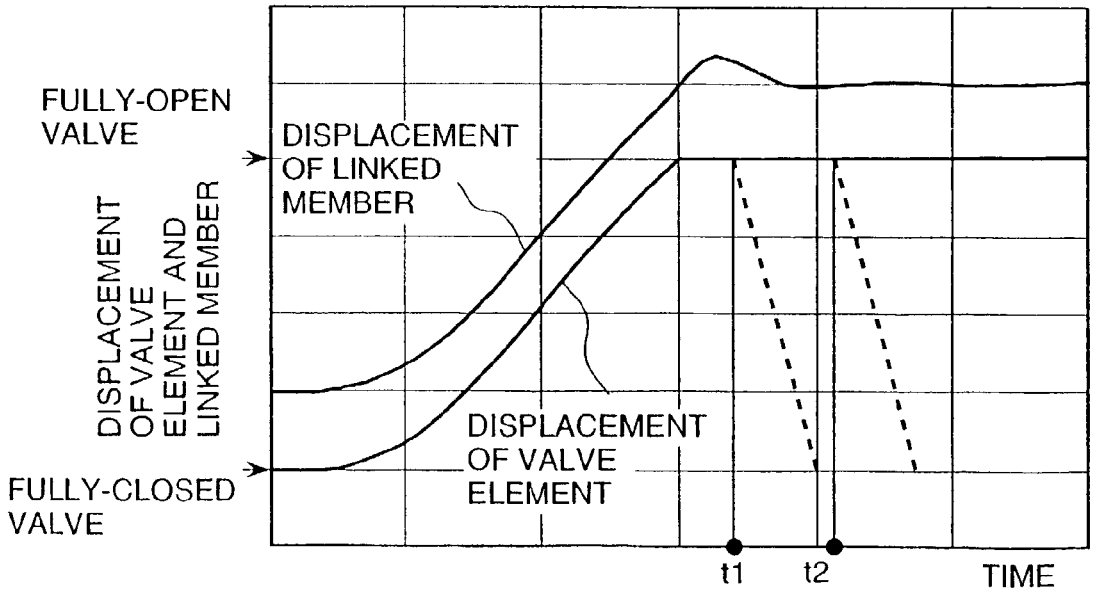
FIG. 9B is a graph showing changes in the displacement of the valve element with the plate spring 17 in the fuel-injection valve shown in FIG. 5.

FIGS. 7A and 7B show two different cases of displacement changes of the valve element 4 and the linked movable member 13', respectively. FIG. 9A and FIG. 9B are graphs showing changes in the displacement of the valve element with and without the plate spring 17' in the fuel-injection valve shown in FIG. 5, respectively. In FIG. 9A, it is seen that a large bounce by the valve element 4 is occurring at the stroke end. On the other hand, in the fuel-injection valve 100' with the linked movable member 13', the bouncing of the valve element 4 is suppressed or completely prevented as shown in FIG. 9B.'

Tp in FIGS. 9A and 9B indicates the time interval of the interruption of the electromagnetic force to the starting of the motion of the valve element 4, from the closed position to the open position. When it is required that a small amount of fuel be injected with a single injection, Tp is shortened.

In a conventional fuel-injection valve, if Tp is significantly shortened, the valve element 4 moves towards the valve seat 3 during the bouncing.

In FIG. 9A, if the electromagnetic force is interrupted at the time point t1 for Tp at which the valve element 4 possesses a negative speed, the displacement of the valve element 4 changes as shown by the dotted line A, and the time until the valve element 4 reaches the closed position is shortened. Conversely, if the electromagnetic force is interrupted at the time point t2 for Tp at which the valve element 4 possesses a positive speed, the displacement of the valve element 4 changes as shown by the dotted line B, and since a time for changing the speed of the valve element 4 from positive to negative is necessary, it takes more time for the valve element 4 to reach the closed position.

The bouncing does not occur always in the same manner, and the period or the amplitude of the bouncing changes every time. Accordingly, even if the electromagnetic force is interrupted with the same Tp, the speed of the valve element 4 is different every time. Therefore, the time until the valve is closed may vary, which in turn may cause a slight variation in the amount of fuel injected.

On the other hand, according to this embodiment, since the bouncing is minimal or completely prevented as shown in FIG. 9B, the valve element 4 can always start toward the closed position from the zero-speed state, and the time until the valve is closed is constant. Thus, since the amount of fuel injected is constant for the same Tp, it is possible to accurately control the amount of fuel injected.

Although it is desirable for the spring 17' to be made of a metallic material, resin can be used for the spring 17' if the durability is ensured. Resin is advantageous if the spring constant is set to a comparatively small value.

The effects obtained by the fuel-injection valve 100 shown in FIG. 1 are also the same as those obtained by the fuel-injection valve 100' shown in FIG. 5.

Figure 10:
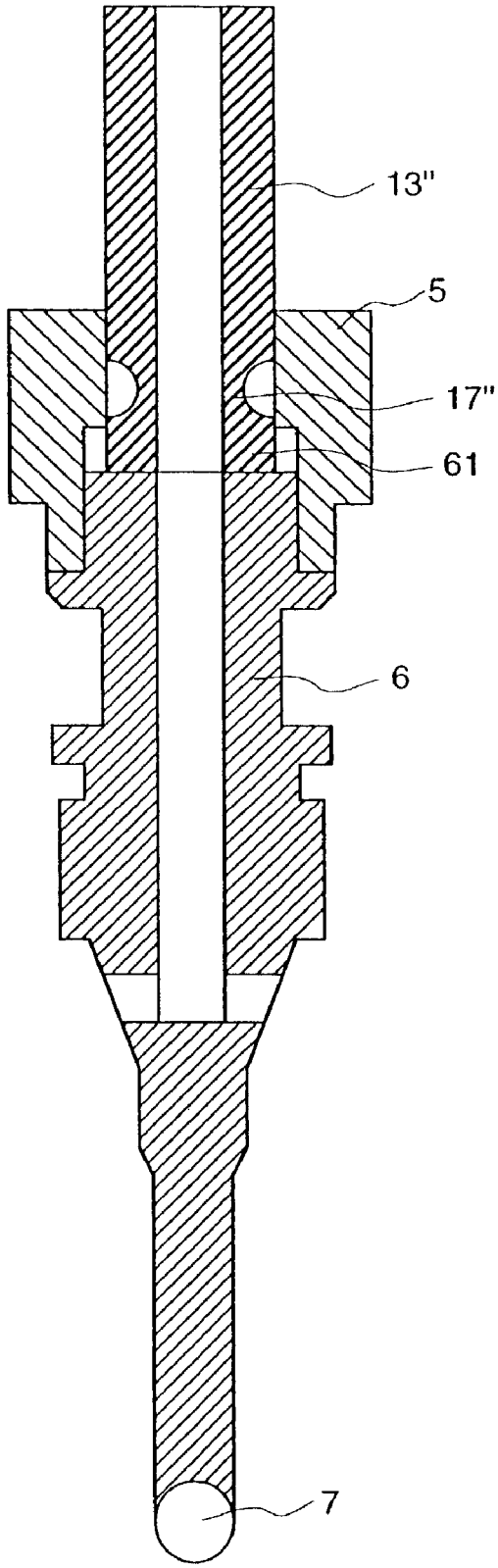
FIG. 10 is a vertical cross section showing another example of the composition of the spring 17.

Another embodiment of the spring 17 will be explained with reference to FIG. 10. By providing a smaller outer-diameter portion (a constricted portion) 17" on the bottom part of the linked movable member 13" the stiffness of the bottom part is decreased, allowing it to possess a spring-like property. If one attempts to prevent the deterioration of the magnetic property of the movable iron core 5 due to the remaining processing strain caused by processing the core 5 to either create a spring portion in the core 5 or fix a spring member to the core 5, it is desirable to use the constricted portion 17" provided in the bottom part of the linked movable member 13" as a spring. In this embodiment, a large-diameter portion 61 is also formed below the constricted portion 17", so as to increase the butting area between the linked movable member 13" and the valve element 4 (the top face of the rod 6). In this way, the butting pressure applied to the bottom face of the linked movable member 13" and the top face of the rod 6 can be reduced, which in turn prevents butting abrasion. If butting abrasion can be prevented by other measures, the large-diameter portion of the linked movable member 13" is not necessary.

Figure 11:
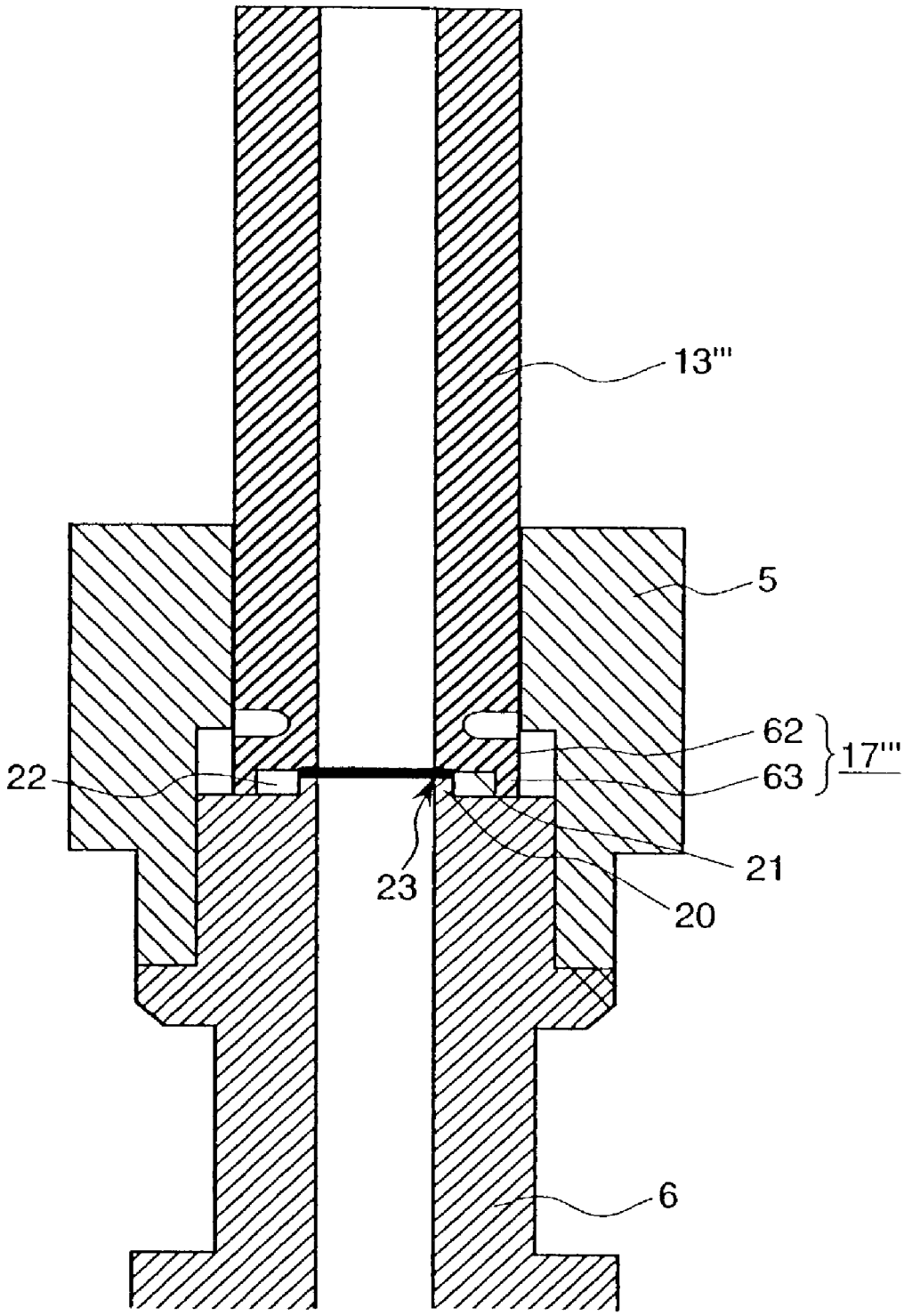
FIG. 11 is a vertical cross section showing another example of the composition of the spring 17.

Further, another embodiment of the spring 17 is explained below with reference to FIG. 11. In this embodiment, the spring portion 17''' is composed of a support part 63 and a deformed part 62. The deformed part 62 is bent with respect to the support part 63, which functions as a fulcrum. Thus, the deformed part 62 works as a spring. If the composition of a spring with a weak spring constant is attempted by adopting the structure of the spring 17' using the compression deformation, as shown in FIG. 10, it is inevitable in some cases that the smaller-diameter portion becomes too thin, and the necessary strength cannot be secured. On the other hand, in this embodiment, since the spring 17''' uses a force due to a bending deformation, it is possible to create a comparatively weak spring constant while securing the necessary thickness.

Moreover, by providing a convex portion 20 and a concave part 21 in the top part of the valve element 4 (the top part of the rod 6) and the bottom part of the linked movable member 13''', a fuel-damper region 22 is formed between the convex and concave potions 20 and 21. During the operation of the valve, the linked movable member 13''' may jump upward, apart from the valve element 4, and then butt against the valve element 4, thereby causing bouncing. In this embodiment, since the fuel inside the fuel-damper region 22 passes through the narrow passage 23 when the linked movable member 13''' again butts against the valve element 4, the viscosity resistance force of the fuel effectively works as a damping force. Accordingly, the bouncing due to the re-butting between the linked movable member 13''' and the valve element 4 can be suppressed. However, this fuel-damper region 22 is not indispensable, and is provided as occasions demand.

Figure 12:
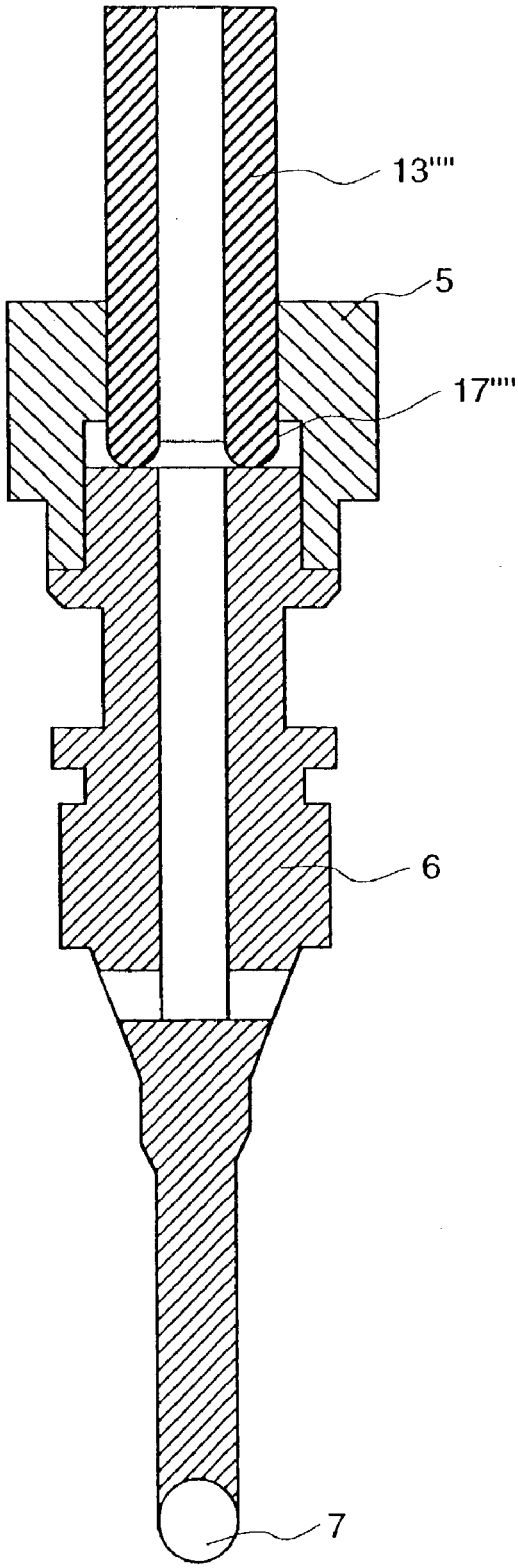
FIG. 12 is a vertical cross section showing another example of the composition of the spring 17.

Furthermore, another embodiment of the spring 17 will be explained with reference to FIG. 12. In this embodiment, the circular bottom face of the linked movable member 13'''' has a convex surface, and the top face of the rod 6 of the valve element 4 has a flat surface. With the above shapes, a spring function can be obtained due to Hertzian contact. According to this embodiment, since the linked movable member 13'''' contacts the valve element 4 in a line-contact manner, both the member 13'''' and the valve element 4 contact each other more uniformly on the periphery as compared to when the member 13'''' and the valve element 4 contact to each other in a surface-contact manner. Thus, the variation in the spring force is small, and a stable bounce-suppression effect can be obtained.

In the structure shown in FIG. 13, a centering error of the spring adjuster 11 is absorbed by the rotation of a ball 64, so as not to affect the spring 12 and the components below the spring 12. Moreover, a fuel outlet 65 and a fuel bypass passage 66 are now included so that the ball 64 does not close the fuel passage.

Figure 13:
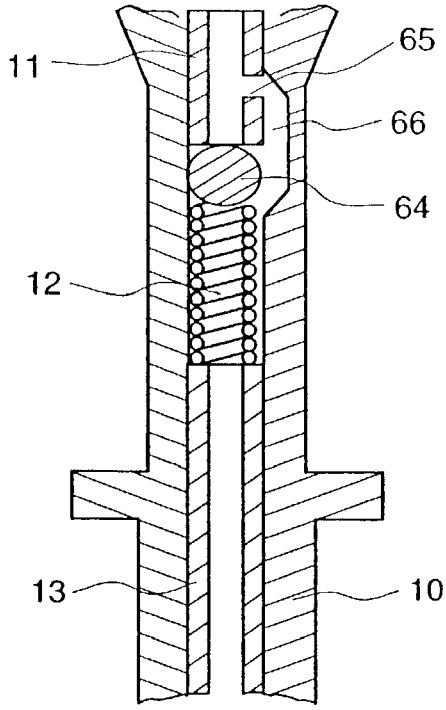
FIG. 13 is a vertical cross section showing an example of the composition of a mechanism for preventing the occurrence of a centering error between the spring adjuster and the spring.
Figure 14:
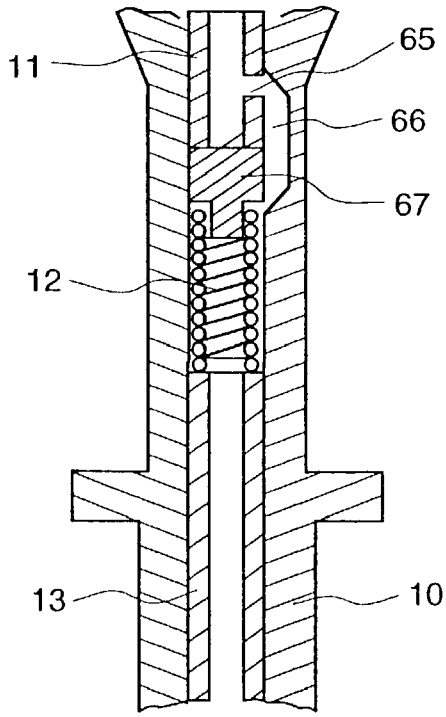
FIG. 14 is a vertical cross section showing another example of the composition of a mechanism for preventing the occurrence of a centering error between the spring adjuster and the spring.

In the embodiment shown in FIG. 14, to prevent a centering error between the spring adjuster 11 and the spring 12, a centering-error prevention part 67 possessing a projecting portion inserted inside the spring 12 above the linked movable member 13 is attached to the bottom of the spring adjuster 11 in place of the ball 64 shown in FIG. 13. The centering-error prevention part 67 and the spring adjuster 11 are fabricated as a united structure, or the centering-error prevention part 67 is welded to the spring adjuster 11. In this embodiment, a fuel passage penetrating the centering-error prevention part 67 along the axis can be included.

Figure 15:
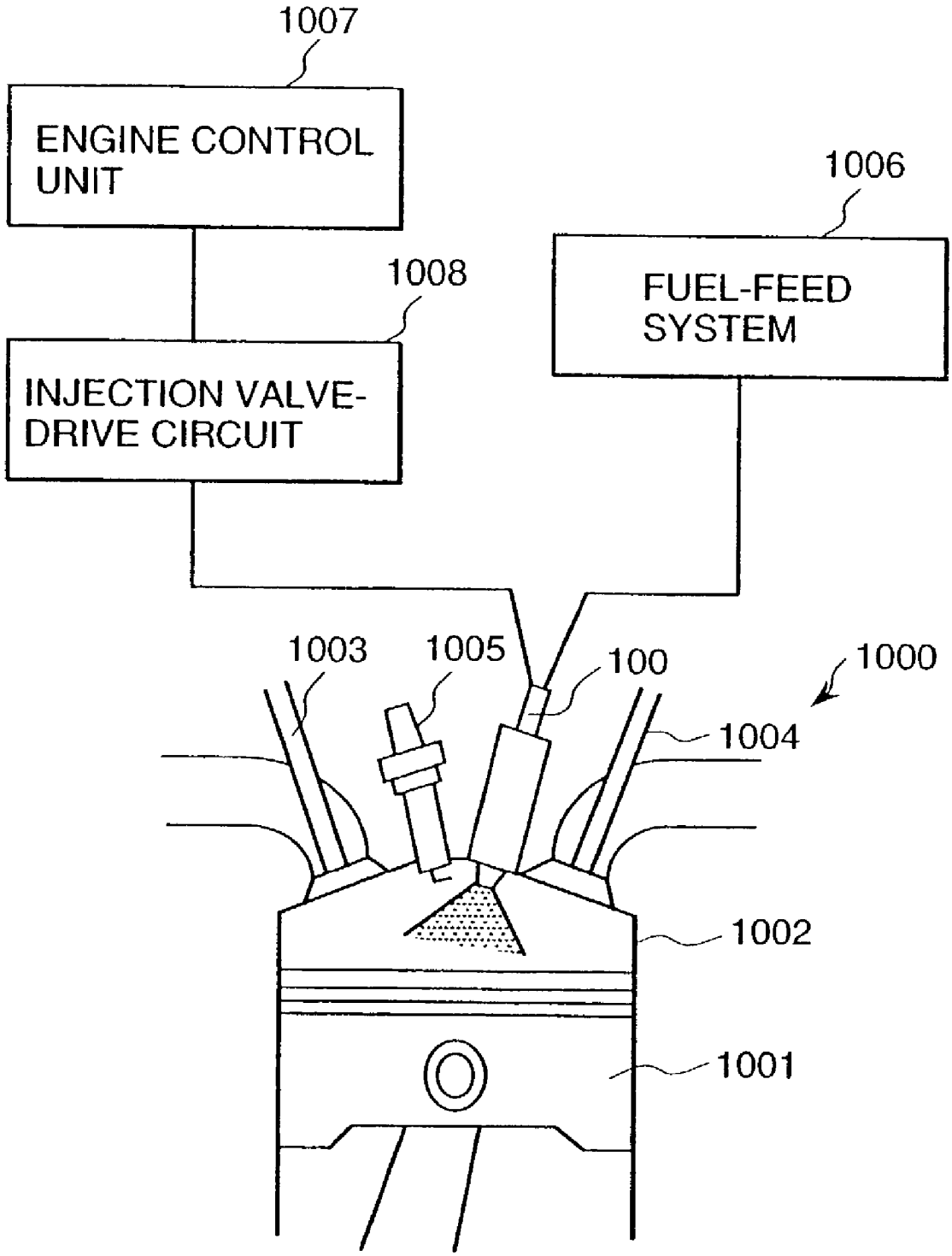
FIG. 15 is a diagram showing the composition of an internal combustion engine using the electromagnetic fuel-injection valve according to the present invention.

In the following, an internal combustion engine using the fuel-injection valves according to the present invention will be explained with reference to FIG. 15.

The internal combustion engine 1000 includes a plurality of cylinders 1002, and each cylinder 1002 also includes a piston 1001, an air-intake valve 1003, an ignition plug 1005, and a fuel-injection valve 100. The air-intake valve 1003 is opened and closed in synchronization with the reciprocal motion of the piston 1001, and intake, air is introduced into each cylinder 1002. Fuel is fed to the fuel-injection valve 100 from a fuel feed system composed of a fuel tank, pumps, and so on, which are not shown in this figure. Current is fed to the fuel-injection valve 100 by an engine control unit 1007 and a fuel-injection valve-drive circuit 1008, and fuel injection is further performed according to the operational state of the internal combustion engine 1000. A mixture of intake-air and fuel is ignited and burned with the ignition plug 1005. Gas generated by this process is expelled by opening an exhaust valve 1004. By fabricating an internal combustion engine with an electromagnetic fuel-injection valve according to the present invention, an internal combustion engine with excellent fuel-consumption, engine power, and gas-exhaustion characteristics can be implemented, because the amount of fuel injected can be accurately controlled.

Additionally, although an electromagnetic force is used to drive the valve element 4 along the axis, use of another drive means can achieve the same effects as those obtained by means of electromagnetic force. For example, a drive means for driving the valve element 4 along the axis by using the fuel pressure to create a pressure difference between the upper and lower sides of the valve element 4, can be applied to the fuel-injection valve according to the present invention.

Although the range of motion along the axis of the valve element 4 is determined by the stopper 9, if the valve element 4 has a range of motion which is restricted by the bottom face of the inner iron core 10, it will naturally achieve the same effects as the above embodiments.

The invention claimed is:

1. A fuel injection valve, which comprises:

a valve seat disposed in the vicinity of a fuel injection hole;

a valve element that sits on or lifts from said valve seat to close or open a fuel path;

a linked movable member installed on said valve element in a manner such that said linked movable member can slide in an axial direction of said valve element and can contact with or separate from said valve element;

a spring to press said valve element to said valve seat via said linked movable member; and an attracting means to attract said valve element to separate from said valve seat against said spring, wherein said valve element and said linked movable element are disposed in a manner such that they can mutually contact through a flat-ring-shaped leaf spring or can separate from each other;

wherein an outer edge of said leaf spring is secured to said valve element;

wherein said linked movable member is arranged in a manner such that an end part of said linked movable member touches to an inner bore of said leaf spring; and wherein a natural frequency of a secondary oscillation system comprised of said linked movable member and said leaf spring is set at such a value that said natural frequency substantially accords with a frequency of an impact force caused from a collision of said valve element with said valve seat.

2. A fuel injection according to claim 1, which further comprises a stopper to regulate the position of the valve element at the end of its stroke in separating movement from said valve seat, wherein the natural frequency of a secondary oscillation system comprised of said linked movable member and said leaf spring is set at a such value that said natural frequency substantially accords with a frequency of an impact force caused from a collision of said valve element with said stopper.

3. A fuel injection valve according to claim 1, wherein a plurality of notches are provided on a perimeter of the inner bore of said flat-ring-shaped leaf spring.

4. A fuel injection valve according to claim 2, wherein a plurality of notches are provided on a perimeter of the inner bore of said flat-ring-shaped leaf spring.

5. A fuel injection valve according to claim 3, wherein said notches are provided at three positions on the perimeter of said inner bore.

6. A fuel injection valve according to claim 4, wherein said notches are provided at three positions on the perimeter of said inner bore.

7. An internal combustion engine including a fuel injection valve which comprises:

a valve seat disposed in the vicinity of a fuel injection hole;

a valve element that sits on or lifts from said valve seat to close or open a fuel path;

a linked movable member installed on said valve element in a manner such that said linked movable member can slide in an axial direction of said valve element and can contact with or separate from said valve element;

a spring to press said valve element to said valve seat via said linked movable member; and an attracting means to attract said valve element to separate from said valve seat against said spring, wherein said valve element and said linked movable element are disposed in a manner such that they can mutually contact through a flat-ring-shaped leaf spring or can separate from each other;

wherein an outer edge of said leaf spring is secured to said valve element;

wherein said linked movable member is arranged in a manner such that an end part of said linked movable member touches to an inner bore of said leaf spring; and wherein a natural frequency of a secondary oscillation system comprised of said linked movable member and said leaf spring is set at such a value that said natural frequency substantially accords with a frequency of an impact force caused from a collision of said valve element with said valve seat.

8. An internal combustion engine according to claim 7, which further comprises a stopper to regulate the position of the valve element at the end of its stroke in separating movement from said valve seat, wherein the natural frequency of a secondary oscillation system comprised of said linked movable member and said leaf spring is set at a such value that said natural frequency substantially accords with a frequency of an impact force caused from a collision of said valve element with said stopper.

9. An internal combustion engine according to claim 7, wherein a plurality of notches are provided on a perimeter of the inner bore of said flat-ring-shaped leaf spring.

10. An internal combustion engine according to claim 8, wherein a plurality of notches are provided on a perimeter of the inner bore of said flat-ring-shaped leaf spring.

11. An internal combustion engine according to claim 9, wherein said notches are provided at three positions on the perimeter of said inner bore.

12. An internal combustion engine according to claim 10, wherein said notches are provided at three positions on the Perimeter of said inner bore.

13. A fuel injection valve according to claim 1, wherein a mass of the linked movable member is 0.3–1.5 g and a spring constant of the leaf spring is 100–1000 KgF/mm.

* * * * *